US009921517B2

(12) United States Patent
Mizuno

(10) Patent No.: US 9,921,517 B2
(45) Date of Patent: Mar. 20, 2018

(54) IMAGE FORMING APPARATUS THAT EXPOSES PHOTOSENSITIVE MEMBER BY LIGHT REFLECTED BY ROTATING POLYGON MIRROR AND SCANNING APPARATUS

(71) Applicant: CANON KABUSHIKI KAISHA, Tokyo (JP)

(72) Inventor: Fumiaki Mizuno, Suntou-gun (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/491,648

(22) Filed: Apr. 19, 2017

(65) Prior Publication Data

US 2017/0336732 A1 Nov. 23, 2017

(30) Foreign Application Priority Data

May 19, 2016 (JP) ..... 2016-100844

(51) Int. Cl.
*G03G 15/00* (2006.01)
*G03G 15/043* (2006.01)

(52) U.S. Cl.
CPC ..... *G03G 15/0435* (2013.01)

(58) Field of Classification Search
CPC ..... G03G 15/0435
See application file for complete search history.

(56) References Cited

U.S. PATENT DOCUMENTS 5,767,890 A 6/1998 Asaya ..... 347/253
2005/0206718 A1* 9/2005 Komiya ..... B41J 2/471 347/246
2007/0242128 A1* 10/2007 Sobue ..... H04N 1/053 347/253
2008/0144132 A1* 6/2008 Koga ..... G03G 15/043 358/475
2008/0278784 A1* 11/2008 Abe ..... G02B 26/0841 359/199.1

(Continued)

FOREIGN PATENT DOCUMENTS

JP 08-18746 1/1996
JP 08-230233 9/1996

(Continued)

*Primary Examiner* — David Bolduc
(74) *Attorney, Agent, or Firm* — Fitzpatrick, Cella, Harper & Scinto

(57) ABSTRACT

An image forming apparatus includes: a detection unit configured to detect light that a light source emits and that is reflected by a polygon mirror in a predetermined direction, and to output a synchronization signal; a speed control unit configured to perform acceleration/deceleration control of the polygon mirror based on the synchronization signal at a target speed; and a light intensity control unit configured to decide an emission intensity of the light source and notify the digital value to the light driving unit. The speed control unit changes control of the polygon mirror to a neutral control in which neither acceleration nor deceleration control is performed in a case the light intensity control unit changes the light intensity of the light source when the speed control unit is performing the acceleration/deceleration control.

13 Claims, 10 Drawing Sheets

(56) References Cited

U.S. PATENT DOCUMENTS

| | | | | |
|---|---|---|---|---|
| 2009/0324293 | A1* | 12/2009 | Tomioka | B41J 2/473<br>399/221 |
| 2010/0074651 | A1* | 3/2010 | Koga | G02B 26/128<br>399/151 |
| 2010/0189452 | A1* | 7/2010 | Tanaka | G03G 15/043<br>399/51 |
| 2011/0150510 | A1* | 6/2011 | Kondo | G03G 15/043<br>399/51 |

FOREIGN PATENT DOCUMENTS

| | | |
|---|---|---|
| JP | 2005-169785 | 6/2004 |
| JP | 2004-226823 | 8/2004 |

* cited by examiner

| CONTROL CONTENT | ACC | DEC |
|---|---|---|
| NEUTRAL | H | H |
| ACCELERATE | L | H |
| DECELERATE#1 | H | L |
| DECELERATE#2 | L | L |

IMAGE FORMING APPARATUS THAT EXPOSES PHOTOSENSITIVE MEMBER BY LIGHT REFLECTED BY ROTATING POLYGON MIRROR AND SCANNING APPARATUS

BACKGROUND OF THE INVENTION

Field of the Invention

The present invention relates to an image forming apparatus that deflects light by a rotating polygon mirror and scans a photosensitive member, and to a scanning apparatus.

Description of the Related Art

Japanese Patent Laid-Open No. 2005-169785 discloses a configuration in which a reference voltage for controlling an emission intensity of light that a light source emits is generated by smoothing a PWM (pulse width modulation) signal that a processor element such as a CPU outputs.

In recent years, in image forming apparatuses, images are formed by scanning photosensitive members by a plurality of light beam to accelerate image formation. Also, in image forming apparatuses, photosensitive members are scanned by causing a polygon mirror having a plurality of reflection surfaces to rotate, and causing a light beam that a light source emits to reflect in a reflection surface of the polygon mirror. At this time, a synchronization signal is generated by detecting a light beam that is reflected towards the outside of the image forming area of the photosensitive member, and rotation control of the polygon mirror is performed based on this synchronization signal. Different light intensities are used when a light beam is reflected toward the inside of the image forming area of the photosensitive member, and when reflected towards the outside of the image forming area of the photosensitive member in order to detect the synchronization signal reliably. Accordingly, in the configuration of Japanese Patent Laid-Open No. 2005-169785, the number of PWM signals for setting the light intensity increases.

A configuration in which a light intensity control unit, to reduce an increase in the number of PWM signals for light intensity setting, notifies a digital value indicating a light intensity to the light driving unit, and the light driving unit controls a light source by deciding a light driving value based on this digital value can be considered. Here, there is a need to perform rotation control of the polygon mirror reliably when changing the light intensity of the light source because the rotation control of the polygon mirror is performed based on the synchronization signal, for example.

SUMMARY OF THE INVENTION

According to an aspect of the present invention, an image forming apparatus includes: a light source; a light driving unit configured to convert a digital value indicating an emission intensity of the light source to an analog signal and to drive the light source by a drive signal obtained based on the analogue signal; a polygon mirror configured to be rotationally driven and to reflect light that the light source emits in order to expose a photosensitive member; a detection unit configured to detect light that the light source emits and that is reflected by the polygon mirror in a predetermined direction, and to output a synchronization signal indicating a detection timing; a speed control unit configured to perform acceleration/deceleration control of the polygon mirror in order to maintain a rotation speed of the polygon mirror based on the synchronization signal at a target speed; and a light intensity control unit configured to decide an emission intensity of the light source and notify the digital value to the light driving unit. The speed control unit changes control of the polygon mirror to a neutral control in which neither acceleration nor deceleration control is performed in a case the light intensity control unit changes the light intensity of the light source when the speed control unit is performing the acceleration/deceleration control.

Further features of the present invention will become apparent from the following description of exemplary embodiments with reference to the attached drawings.

DESCRIPTION OF THE EMBODIMENTS

Exemplary embodiments of the present invention will be described hereinafter, with reference to the drawings. Note, the following embodiments are examples and the present invention is not limited to the content of the embodiments. Also, for the following drawings, elements that are not necessary in the explanation of the embodiment are omitted from the drawings.

First Embodiment

Figure 1:
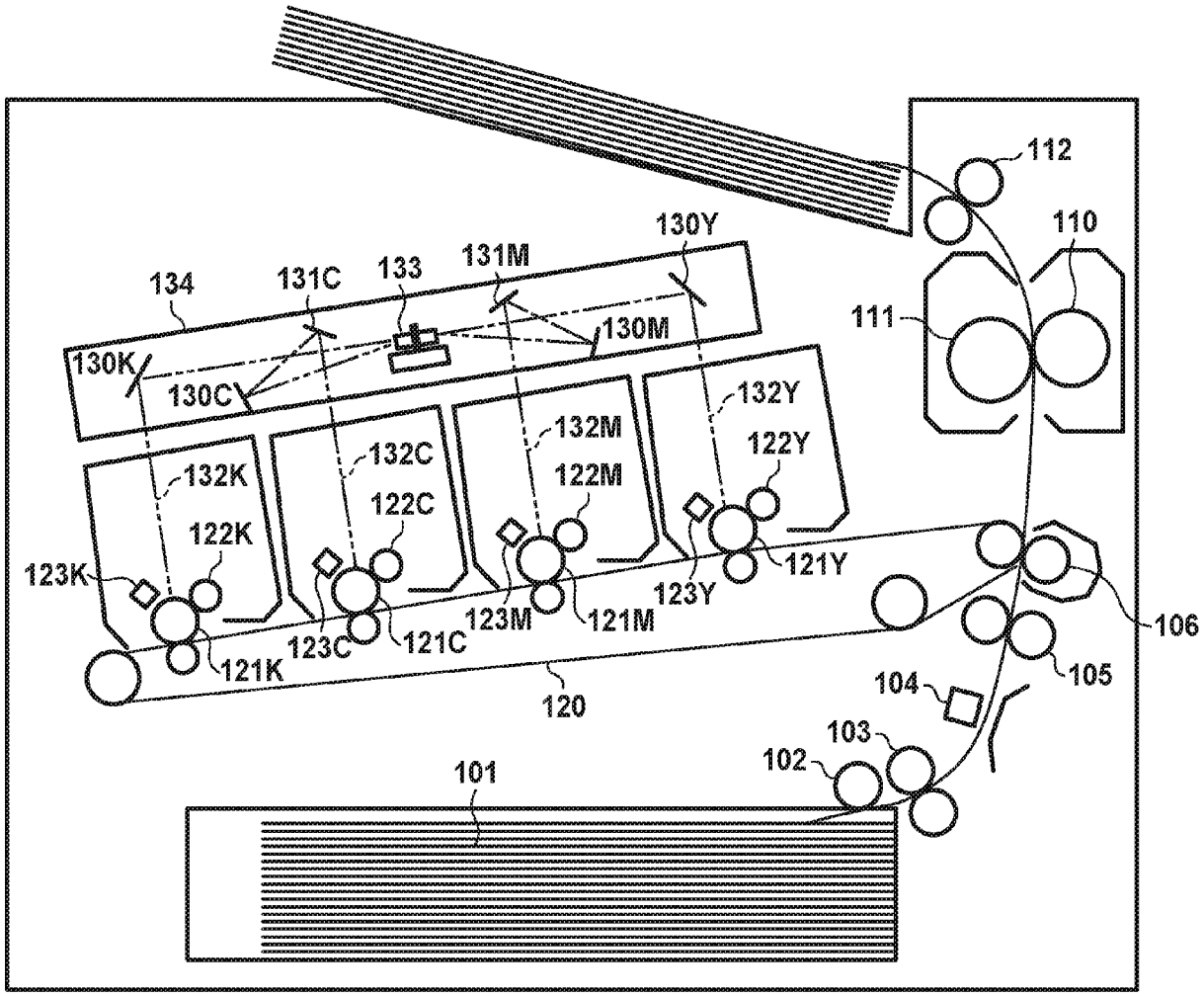
FIG. 1 is a configuration diagram of an image forming apparatus according to an embodiment.

FIG. 1 is a configuration diagram of the image forming apparatus according to this embodiment. Note, in the figures hereinafter, the letters Y, M, C, and K at the end of a reference numeral indicate that the color of the toner image relating to formation by the corresponding member is yellow, magenta, cyan, or black respectively. In the following description, reference numerals are used excluding the letter at the end in a case where it is not necessary to distinguish the color of the toner image. A photosensitive member 121 is rotated in a counterclockwise direction in the figure at a time of image formation. A charge roller 122 causes the surface of the photosensitive member 121 to be charged to a uniform electric potential. A scanning unit 134 scans the surface of the photosensitive member 121 by a light beam 132 by causing the light beam 132 to reflect on a reflection surface of a rotating polygon mirror 133 from a light source (not shown) and forms an electrostatic latent image on the photosensitive member 121 by this. Note, in FIG. 1, reference numerals 130 and 131 are each reflective mirrors for reflecting the light beam 132 reflected on the rotating polygon mirror 133 in the direction of the photosensitive member 121. A developer (not shown) develops an electrostatic latent image on the photosensitive member 121 by toner to visualize it as a toner image. A toner image formed on each photosensitive member 121 is transferred to an intermediate transfer belt 120. The intermediate transfer belt 120 is rotated clockwise in the figure at a time of image formation, and by this, the toner image transferred to the intermediate transfer belt 120 is conveyed to a position facing a transfer roller 106. Meanwhile, a paper feed roller 102 feeds a recording medium 101 in a conveyance path and a feed roller 103 conveys the recording medium 101 further downstream. A sensor 104 determines the type and the grammage of the recording medium conveyed. After this, a conveyance roller 105, aligning with a timing at which the toner image transferred to the intermediate transfer belt 120 reaches a position facing the transfer roller 106, conveys the recording medium 101 to a position facing the transfer roller 106. Then, the transfer roller 106 transfers the toner image transferred to the intermediate transfer belt 120 to the recording medium 101. After this, the recording medium 101 is conveyed to a fixing unit configured by a fixing roller 111 and a pressure roller 110. The fixing unit applies heat and pressure to the recording medium 101, and by this, causes the toner image to be fixed onto the recording medium 101. After this, the recording medium 101 on which the toner image is fixed is discharged to the outside of the apparatus by a discharge roller 112. Note, a potential sensor 123, which measures a surface potential of the photosensitive member 121, is arranged downstream in the rotation direction of the photosensitive member 121 with respect to the position of exposure of the photosensitive member 121 by the scanning unit 134.

Figure 2:
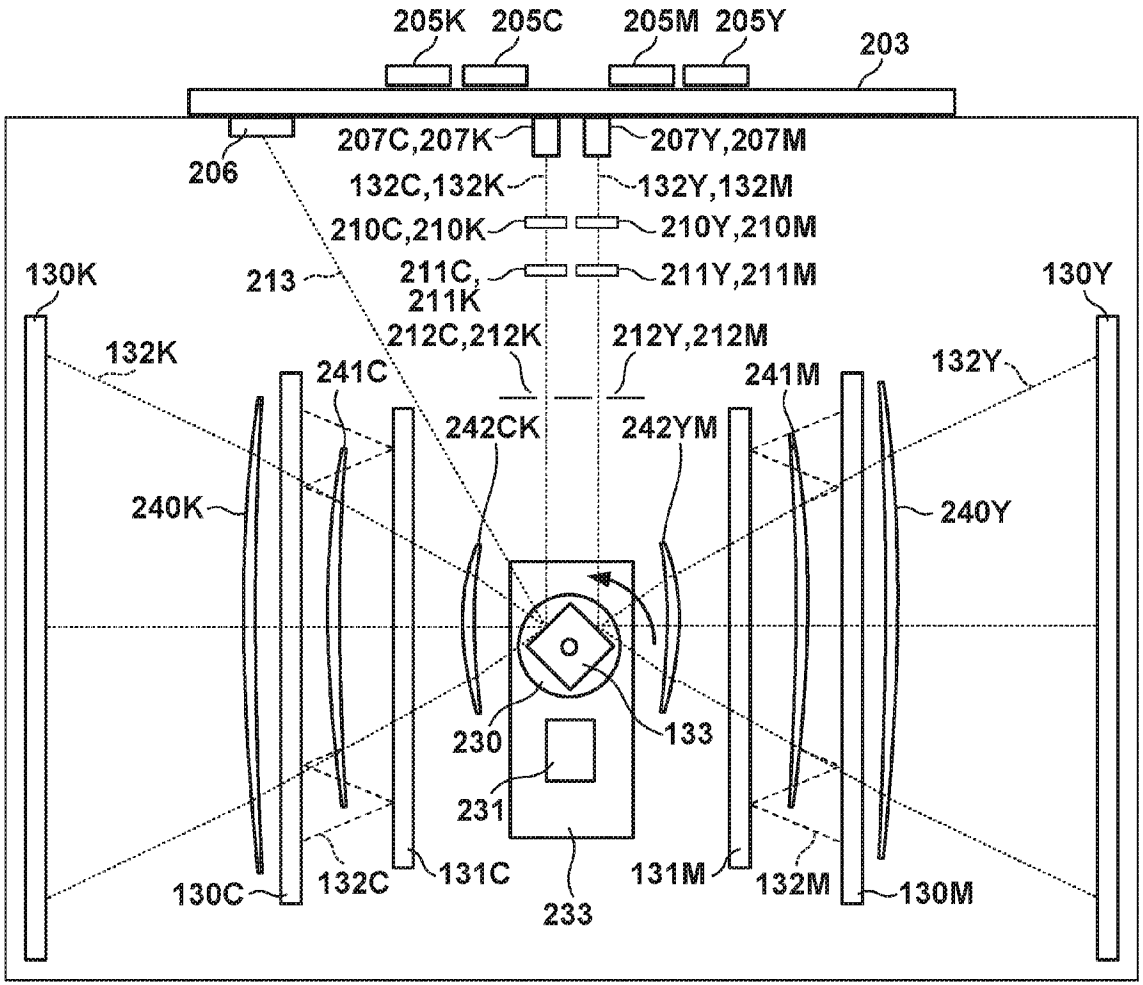
FIG. 2 is a configuration diagram of a scanning unit according to an embodiment.

FIG. 2 is a plan view of the scanning unit 134 according to this embodiment. A driver IC 205, a synchronization signal generation IC 206, and a light source unit 207 are implemented in a substrate 203. Each light source unit 207 emits the light beam 132 by a current supplied from a corresponding driver IC 205. The light beam 132 passes through a collimator lens 210, a cylindrical lens 211, and a diaphragm 212, and is incident on the rotating polygon mirror 133. A motor driver IC 231 of a motor unit 233 causes a motor 230 to rotate and by this, the rotating polygon mirror 133 rotates. The light beam reflected on the reflection surface of the rotating polygon mirror 133 passes through each lens 240, 241, and 242, and is reflected on reflective mirrors 130 and 131 to expose/scan the photosensitive member 121. Also, the synchronization signal generation IC 206 detects the light beam, illustrated by a reference numeral 213, reflected in a predetermined direction by the rotating polygon mirror 133. The synchronization signal generation IC 206 generates a synchronization signal in a main scanning direction based on a detection timing of the light beam.

Figure 3:
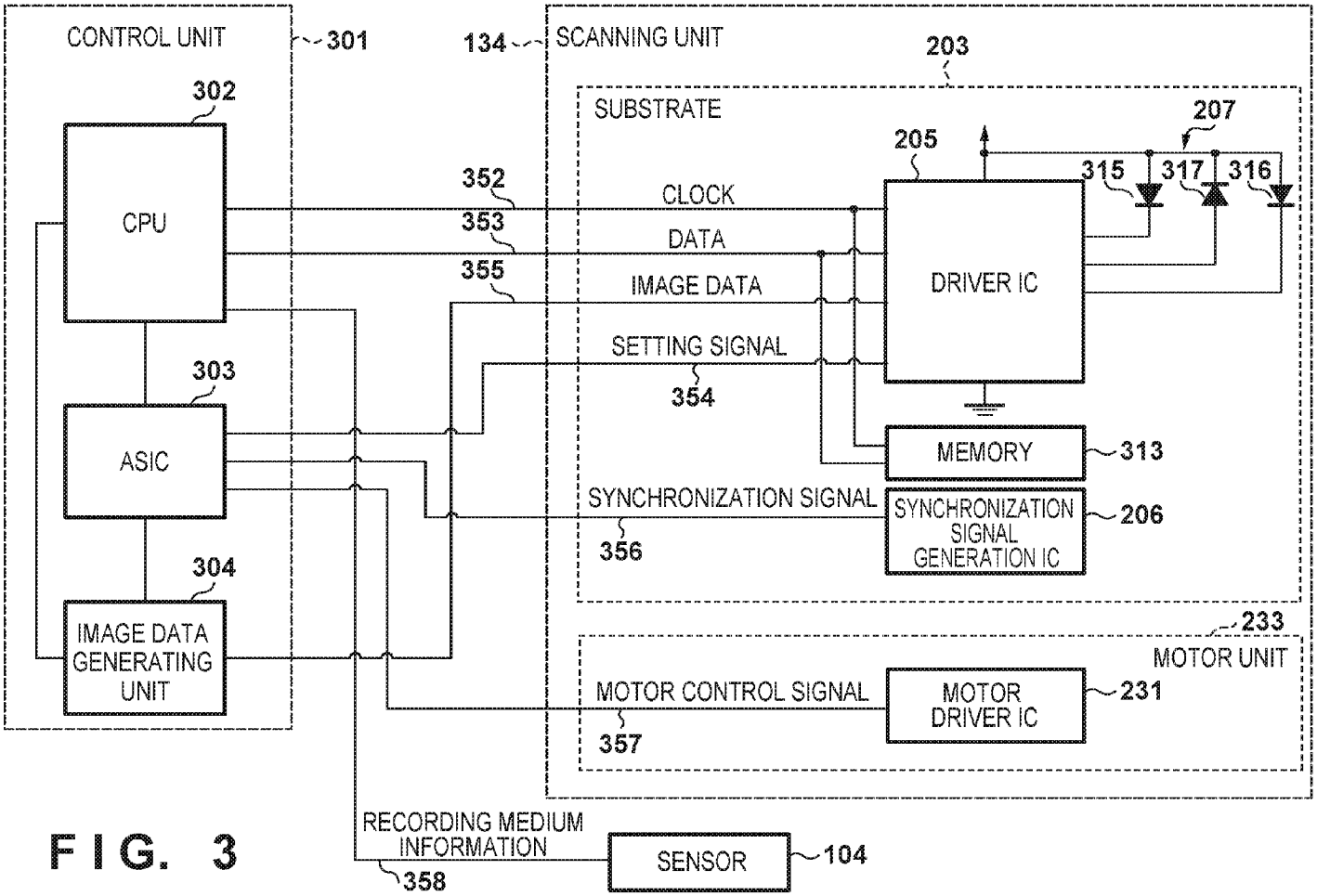
FIG. 3 is a figure illustrating a control configuration including the scanning unit according to an embodiment.

FIG. 3 is a view illustrating a control configuration of the image forming apparatus according to this embodiment. Note, although the driver IC 205 and the light source unit 207 are arranged corresponding to each color used in image formation as illustrated in FIG. 2, the control configurations are the same and only one is displayed in FIG. 3 for simplicity of the figure. A CPU 302 of a control unit 301 is bus-connected to the driver IC 205 and a memory 313 implemented in the substrate 203, and performs two-way communication with them. Note, signals flowing through the bus are a clock 352 and data 353. An ASIC 303 is under the control of the CPU 302 and outputs a setting signal 354 to each driver IC 205 to perform a setting of the driver IC 205. Also, as described above, the synchronization signal generation IC 206 outputs a synchronization signal 356 to the ASIC 303. The ASIC 303 outputs a motor control signal 357 to the motor driver IC 231 of the motor unit 233 based on the synchronization signal 356, and by this, performs a rotation control of the rotating polygon mirror 133. Also, attribute information, such as the type or the grammage of the recording medium 101 that the sensor 104 detects, of the recording medium is inputted to the CPU 302 as recording medium information 358. An image data generating unit 304 outputs image data 355 that indicates an image to be formed to the driver IC 205. The light source unit 207 of the present embodiment is equipped with a plurality of light sources 315 and 316 and outputs a plurality of light beams to perform an image formation. Also, a light receiving unit 317 is arranged for an adjustment of the light intensities of the light sources 315 and 316. The driver IC 205 causes the light sources 315 and 316 to emit in accordance with the image data 355, and by this, expose the photosensitive member 121. In this way, the driver IC 205 operates as a light driving unit that drives the light source. Note that here, although an apparatus equipped with two light sources is described as one example, the number of light sources is not limited to this, and may be one or more than two.

Figure 4:
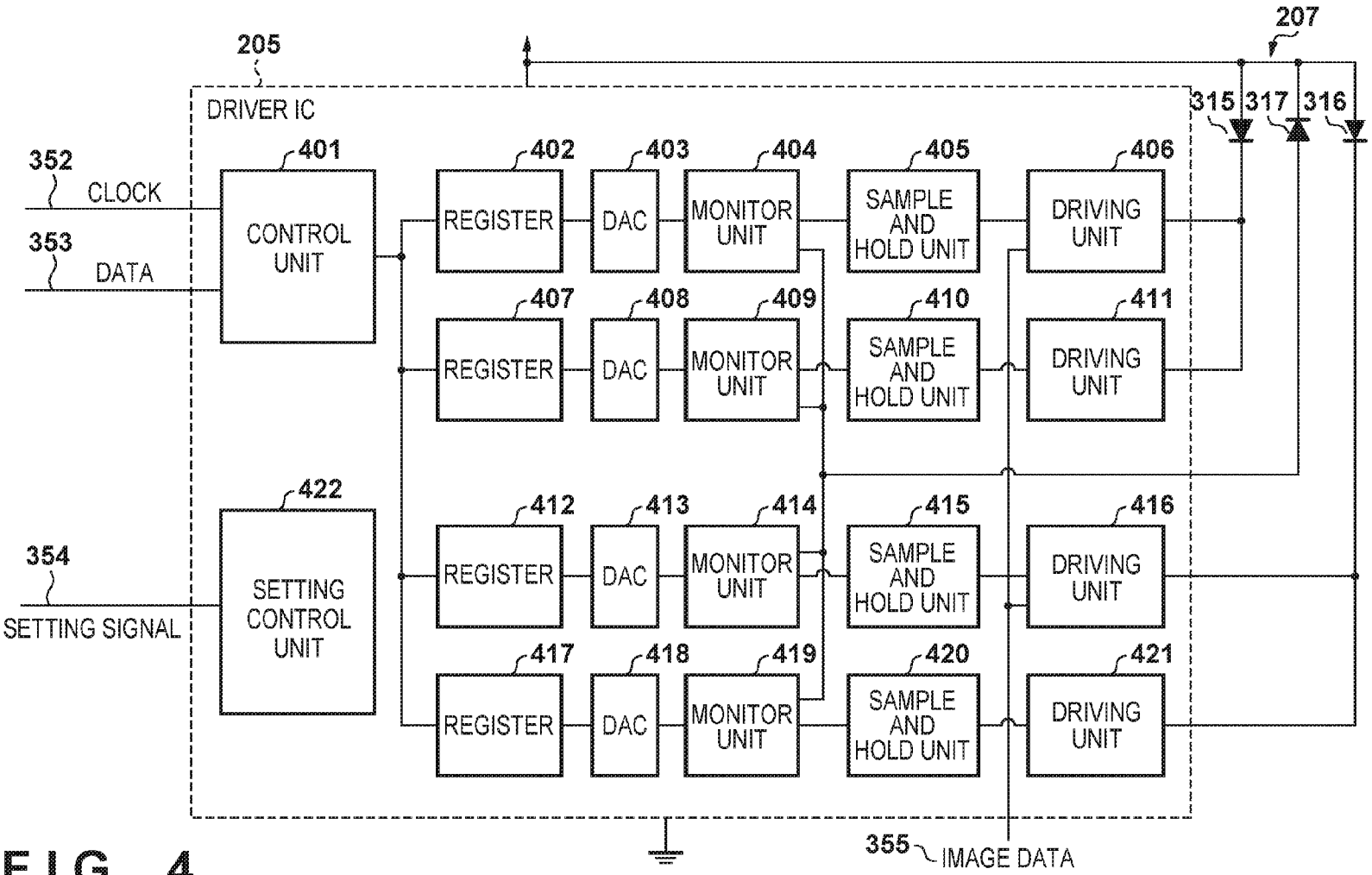
FIG. 4 is a block diagram of a driver IC according to an embodiment.

FIG. 4 is a block diagram illustrating an internal configuration of the driver IC 205. The CPU 302 communicates with a control unit 401 by the clock 352 and the data 353. In the present embodiment, the CPU 302 operates as a light intensity control unit that controls emission intensities of the light sources 315 and 316. Accordingly, the CPU 302 makes a notification to the control unit 401 of the driver IC 205 of light intensity data indicating the emission intensities of the light sources 315 and 316 by digital values according to the data 353. The control unit 401 writes the light intensity data indicating the emission intensities by digital values to registers 402, 407, 412, and 417. As described above, the light source unit 207 of the present embodiment is equipped with two light sources 315 and 316. In the present embodiment, the emission intensity when the light beam is scanning within the image forming area of the photosensitive member 121 and the emission intensity when it is scanning outside of the image forming area of the photosensitive member 121 are set individually. This is to make the synchronization signal generation IC 206 reliably detect the synchronization signal outside the image forming area. In other words, this is to optimize the light intensity of the light beam for image formation and the light intensity of the light beam for generating the synchronization signal respectively. Accordingly, the driver IC 205 has four paths for adjusting the light intensities in the present embodiment. The first path is a path from a register 402 to a driving unit 406 in FIG. 4, and this sets the light intensity when the light beam that the light source 315 emitted irradiates within the image forming area of the photosensitive member 121. The second path is a path from a register 407 to a driving unit 411 in FIG. 4, and this sets the light intensity when the light beam that the light source 315 emitted irradiates outside the image forming area of the photosensitive member 121. The third path is a path from a register 412 to a driving unit 416 in FIG. 4, and this sets the light intensity when the light beam that the light source 316 emitted irradiates within the image forming area of the photosensitive member 121. The fourth path is a path from a register 417 to a driving unit 421 in FIG. 4, and this sets the light intensity when the light beam that the light source 316 emitted irradiates outside the image forming area of the photosensitive member 121.

Note, description is given only regarding the first path as a representative hereinafter because the operation of each path is the same. A digital-to-analog converter (DAC) 403 converts the digital value which is the light intensity data written in the register 402 to an analog value. More specifically, the digital value written in the register 402 is converted to an analog signal such as an analog voltage or current. A monitor unit 404 receives information relating to the emission intensity of the light source 315 from the light receiving unit 317 and compares it with the analog voltage or current that the DAC 403 outputted. Then, a light driving value of the driving unit 406 is decided so that the emission intensity of the light source 315 approaches a value that the analog voltage or current that the DAC 403 outputted indicates. In other words, the monitor unit 404 executes a so-called automated light intensity control (APC). Note, the APC is executed only in a case when the CPU 302 performs an APC instruction. A sample and hold unit 405 stores the light driving value that the monitor unit 404 decided by the APC. The driving unit 406 outputs a light driving signal based on the light driving value that the sample and hold unit 405 stores to cause the light source 315 to emit. Note, the setting signal 354 that the ASIC 303 outputted is input to a setting control unit 422. The setting control unit 422 is configured to be able to communicate with each functional block of the driver IC 205 and controls each functional block based on the contents that the setting signal 354 indicates. Note, the driver IC 205 is configured such that it can be set to a first mode or a second mode by the ASIC 303 in the present embodiment. In the first mode, the light sources 315 and 316 emit at emission intensities based on the light driving values. Meanwhile, the driver IC 205 stops the emission of the light sources 315 and 316 or makes the emission intensities of the light sources 315 and 316 less than a predetermined value irrespective of the light driving value that the sample and hold unit 405 stores when the second mode is set.

In the present embodiment, the setting values of the emission intensities are set to the registers 402, 407, 412, and 417 by communication with the CPU 302 and each light driving value is decided by performing the APC. In other words, a communication between the CPU 302 and the driver IC 205 is performed by a pair of communication lines. On the other hand, 4 PWM signals are required for one color when PWM signals are used such as in the configuration as recited in Japanese Patent Laid-Open No. 2005-169785. In this way, a number of signals for a light intensity adjustment, in other words the number of wires, can be reduced in the present embodiment.

Figures 5A, 5B:
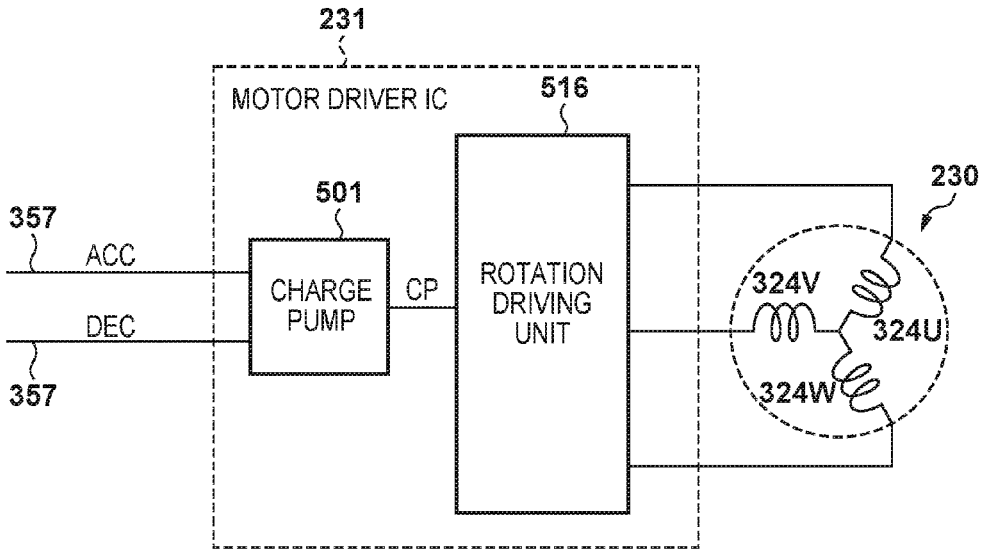
FIGS. 5A and 5B are explanatory views of a rotation control of a polygon mirror according to an embodiment.

FIGS. 5A and 5B are the explanatory views of a control of a rotation of the rotating polygon mirror 133. For the motor control signal 357 that the ASIC 303 outputs, there are two signals: ACC and DEC, and ACC and DEC are each set to high (H) or low (L). In a case of accelerating the motor 230, ACC is set to L and DEC is set to H as illustrated in FIG. 5B. In such a case, a charge pump 501 causes a CP voltage to rise. A rotation driving unit 516 decides an energization duty based on the CP voltage and supplies a current to a motor winding 324 of the motor 230. Note, a rotation speed and a phase of the motor 230 are detected by a Hall element (not shown). Meanwhile, in a case of decelerating the motor 230, ACC is set to H and DEC is set to L as illustrated in FIG. 5B. In such a case, the charge pump 501 causes the CP voltage to decrease and by this, the motor 230 is decelerated. Note, when ACC and DEC are both set to L, the motor winding 324 is short-circuited, and the motor 230 is decelerated by a braking force generated thereby. In this way, the motor control signal 357 that the ASIC 303 outputted is a signal indicating a speed modification instruction of the motor 230 and the charge pump 501 updates the CP voltage which is a rotation driving value based on the motor control signal 357. Also, the rotation driving unit 516 causes the motor 230 to rotate at a rotation speed in accordance with the CP voltage.

As illustrated in FIG. 5B, the charge pump 501 sets the output to a high impedance state and causes the CP voltage to be maintained, in other words, does not cause it to change when ACC and DEC are both set to H. In this state, the current amount to the motor winding 324 is not changed, and by this, the rotation speed of the motor 230 is maintained. Note that in reality, the rotation speed changes by a change or the like of the current to the motor winding 324 due to a leakage current, a variation of load according to a bearing temperature rise, or the like. Note that hereinafter, a change of the CP voltage is not performed, and by this, the state in which the rotation speed of the motor 230 is maintained is called a neutral state and such control of the motor 230 is called neutral control. Meanwhile, in order to maintain the rotation speed of the motor 230 at a target speed, the ASIC 303 performs an acceleration control or a deceleration control by comparing the rotation speed of the motor 230 and the target speed based on the synchronization signal 356. In this way, the control for maintaining the rotation speed of the motor 230 at a target speed while performing an acceleration/deceleration control is called speed difference control hereinafter.

Figure 6:
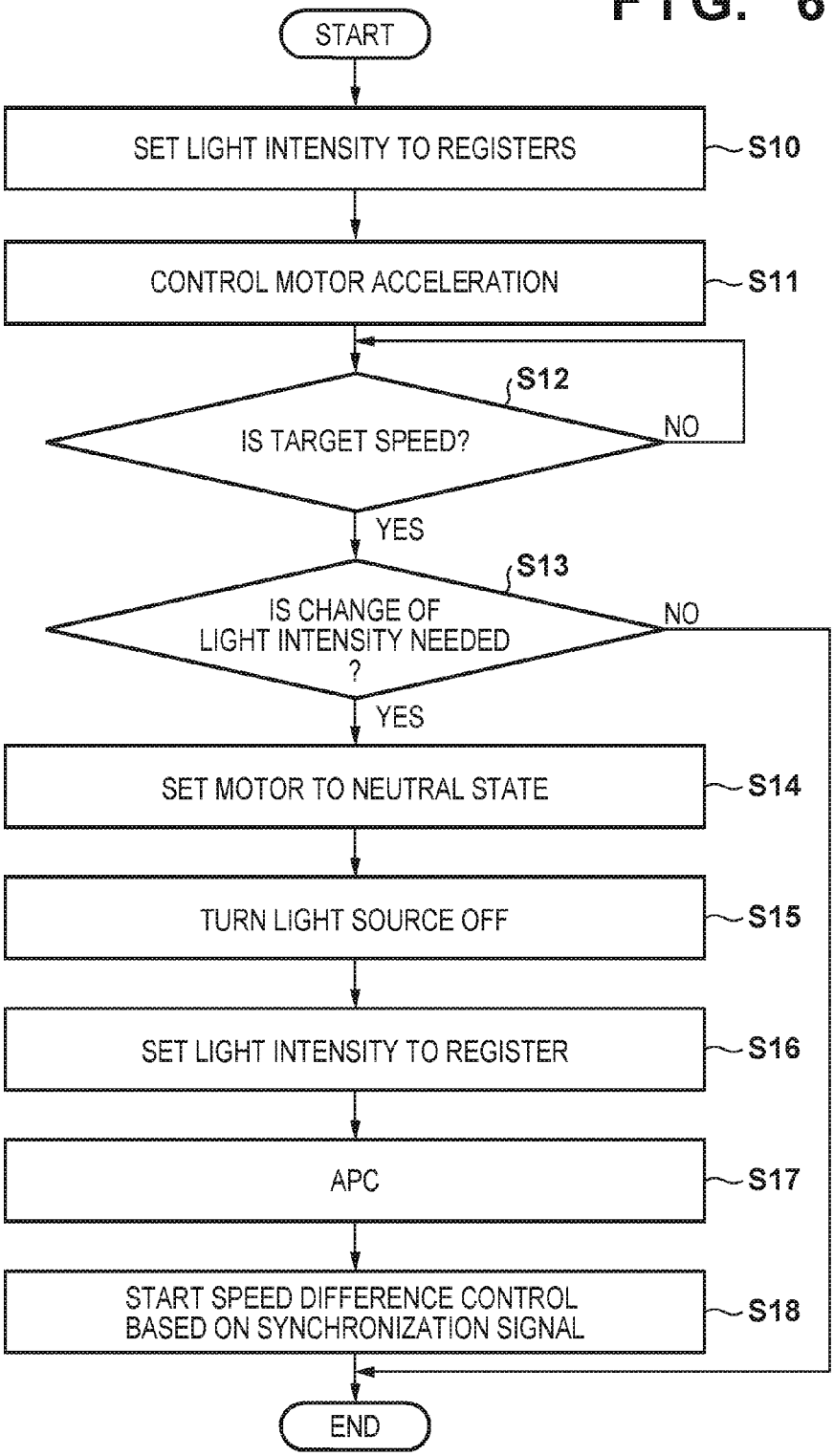
FIG. 6 is a flowchart of light intensity modification processing according to an embodiment.

FIG. 6 is a flowchart of an emission intensity control of the scanning unit 134 according to this embodiment. For example, the CPU 302 sets light intensity data to the registers 402, 407, 412, and 417 in step S10 upon a start of image formation. Also, the ASIC 303 performs an acceleration control of the motor 230 by the motor control signal 357 in step S11. After this, the control unit 301 waits until the motor 230 reaches a target speed in step S12. The CPU 302 determines whether or not a change of light intensity is necessary when the motor 230 reaches the target speed in step S13. Note, the control of the motor 230 at that time is a speed difference control. In the present embodiment, the light intensity is assumed to change in accordance with the attribute information, for example the type or the grammage of the recording medium 101 that the sensor 104 detected, and the CPU 302 determines whether or not a change of the light intensity is necessary based on the recording medium information 358 from the sensor 104. If a change of the light intensity is not necessary, the emission intensity control ends and image formation is performed. Meanwhile, the ASIC 303 changes the control of the motor 230 to the neutral control in step S14 when a change of the light intensity is necessary. In other words, it sets the motor 230 to the neutral state. Also, the ASIC 303 sets the driver IC 205 to the above-described second mode by the setting signal 354. In other words, the ASIC 303 causes the emission of the light sources 315 and 316 to stop. Note, configuration may be taken so that the light sources 315 and 316 are caused to emit at a light intensity smaller than a predetermined value rather than causing the emission of the light sources 315 and 316 to stop.

After this, the CPU 302 sets the changed light intensity data to the registers 402, 407, 412, and 417 in step S16. The ASIC 303 sets the driver IC 205 to the foregoing first mode and the CPU 302 makes an APC instruction to the driver IC 205 in step S17. By this, a light driving value based on the changed light intensity data is set in the sample and hold units 405, 410, 415, and 420. After this, the ASIC 303 changes the control of the motor 230 to the speed difference control and performs speed control of the motor 230 based on the synchronization signal 356 in step S18. By this, the change of the light intensity ends and image formation is performed on the recording medium 101. Note, the CPU 302 makes a notification of changed light intensity data to the driver IC 205 after the motor 230 is set to the neutral state and the driver IC 205 is set to the second mode in the present embodiment. However, the timing to notify the driver IC 205 of the changed light intensity data may be before the motor 230 is set to the neutral state or before the driver IC 205 is set to the second mode since the light driving value is stored in the sample and hold unit. However, a change of the light driving value based on the changed light intensity data is performed after the motor 230 is set to the neutral state and the driver IC 205 is set to the second mode.

Figure 7:
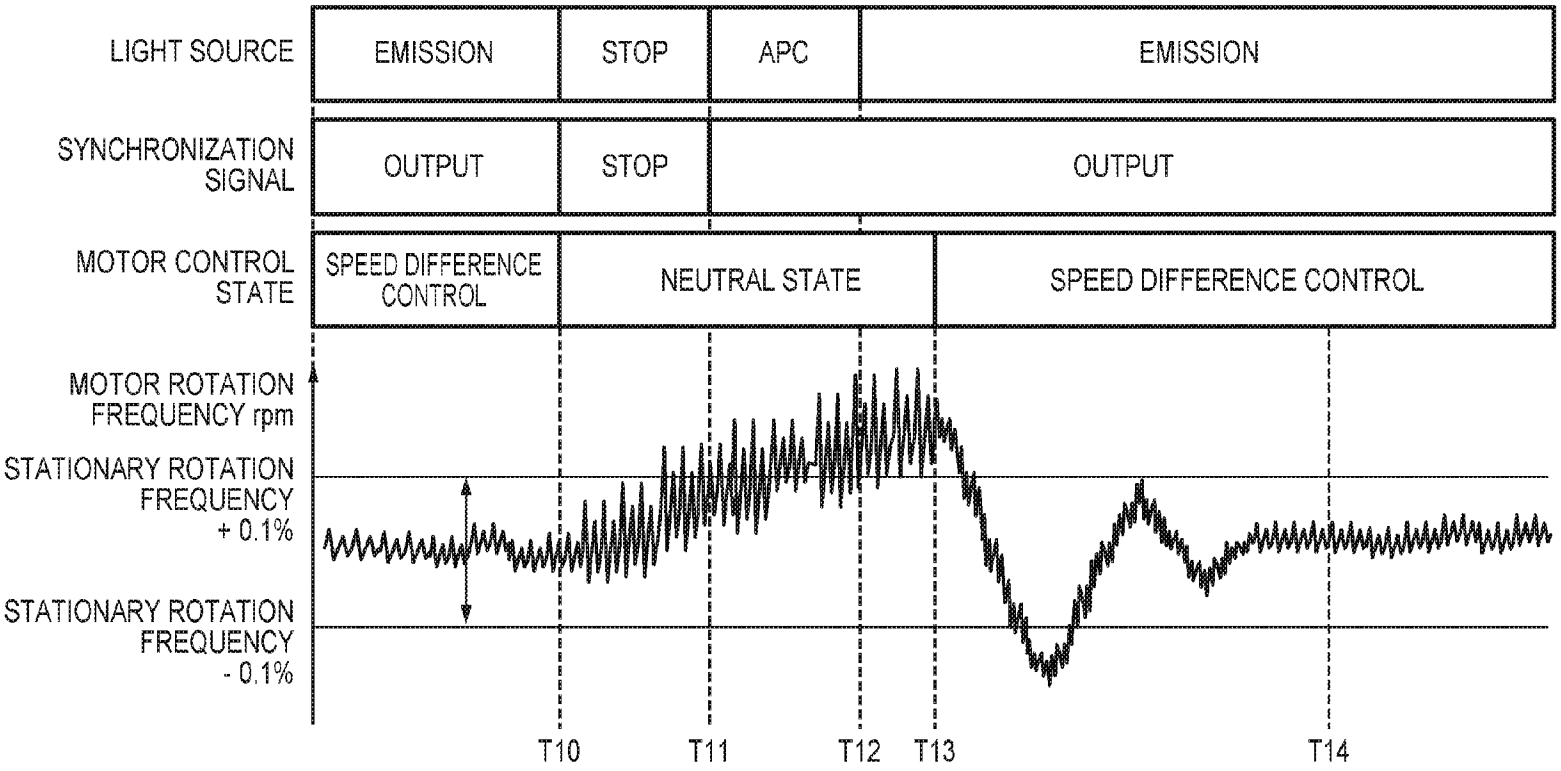
FIG. 7 is a timing chart of light intensity modification processing according to an embodiment.

FIG. 7 is a timing chart of an emission intensity control of the scanning unit 134 according to this embodiment. The ASIC 303 changes the control of the motor 230 to the neutral control at a time T10 when the CPU 302 determines that a change of the setting of the light intensity is necessary. Further, the ASIC 303 causes the emission of the light sources 315 and 316 to stop. By this, the synchronization signal 356 stops outputting. At a time T11, the driver IC 205 performs the APC when the setting change of the registers 402, 407, 412, and 417 by the CPU 302 completes. Note, the APC causes each light source to emit in order and is performed by monitoring the emission intensities of each light source by the light receiving unit 317. The ASIC 303 changes the control of the motor 230 to the speed difference control at T13 when the APC completes at time T12. Note, the time required from the time T10 to the time T13 is within a few 10 s of milliseconds.

A rotation frequency of the motor 230 may change while the motor 230 is in the neutral state as illustrated in FIG. 7. Note, this change is approximately a few percent with respect to the target speed (stationary rotation frequency). The rotation speed of the motor 230 at a time T14 converges to the target speed after the control of the motor 230 set to the neutral state returns to the speed difference control at the time T13 as illustrated in FIG. 7. The time T10 through to the time T14 is a period sufficiently shorter than 100 milliseconds and a suspension time of the image formation according to the change of the light intensity is very short.

Figure 8:
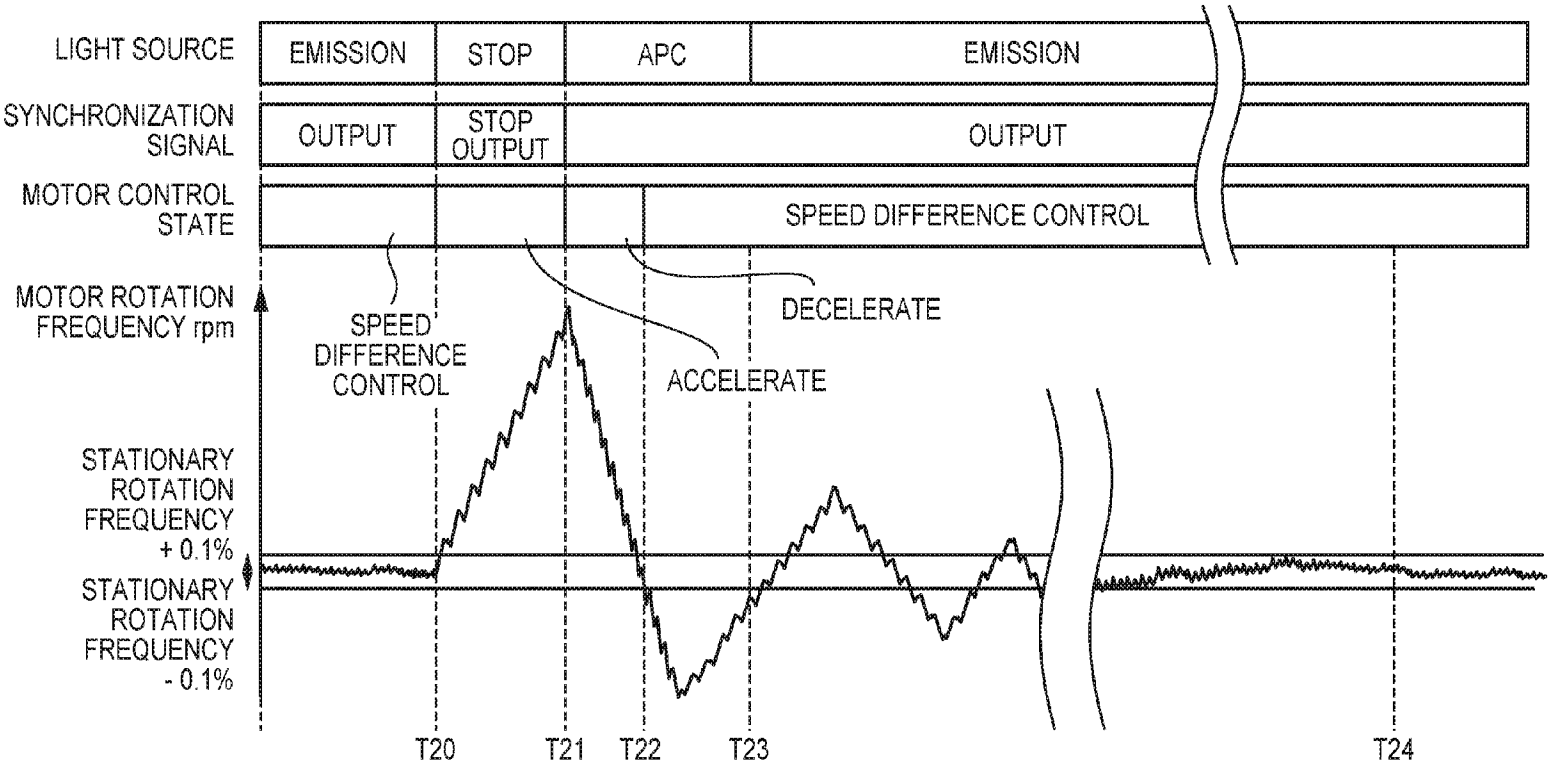
FIG. 8 is a timing chart of a case when a neutral state is not set in the light intensity modification processing.

FIG. 8 is a timing chart of a case when a change of the emission intensity of the light source unit 207 is performed without setting the motor 230 to the neutral state. At T20, the output of the synchronization signal 356 is also stopped in order to cause the emission of the light sources 315 and 316 to stop. By this, the ASIC 303 determines that the rotation of the motor 230 has slowed and performs the acceleration control. Although the synchronization signal 356 is outputted when the light source emits due to the APC at T21, it takes time until the convergence to the target speed because the acceleration control is performed. For example, the period from the time T20 to the time T24 is greater than or equal to a few hundred milliseconds. Also, the motor 230 causes a loud, abrasive sound to occur because it is rotating at a speed faster than the stationary rotation frequency. Additionally, there is an increased possibility of damage to bearings of the motor 230 due to the rotation at a higher speed than the target speed.

Figure 9:
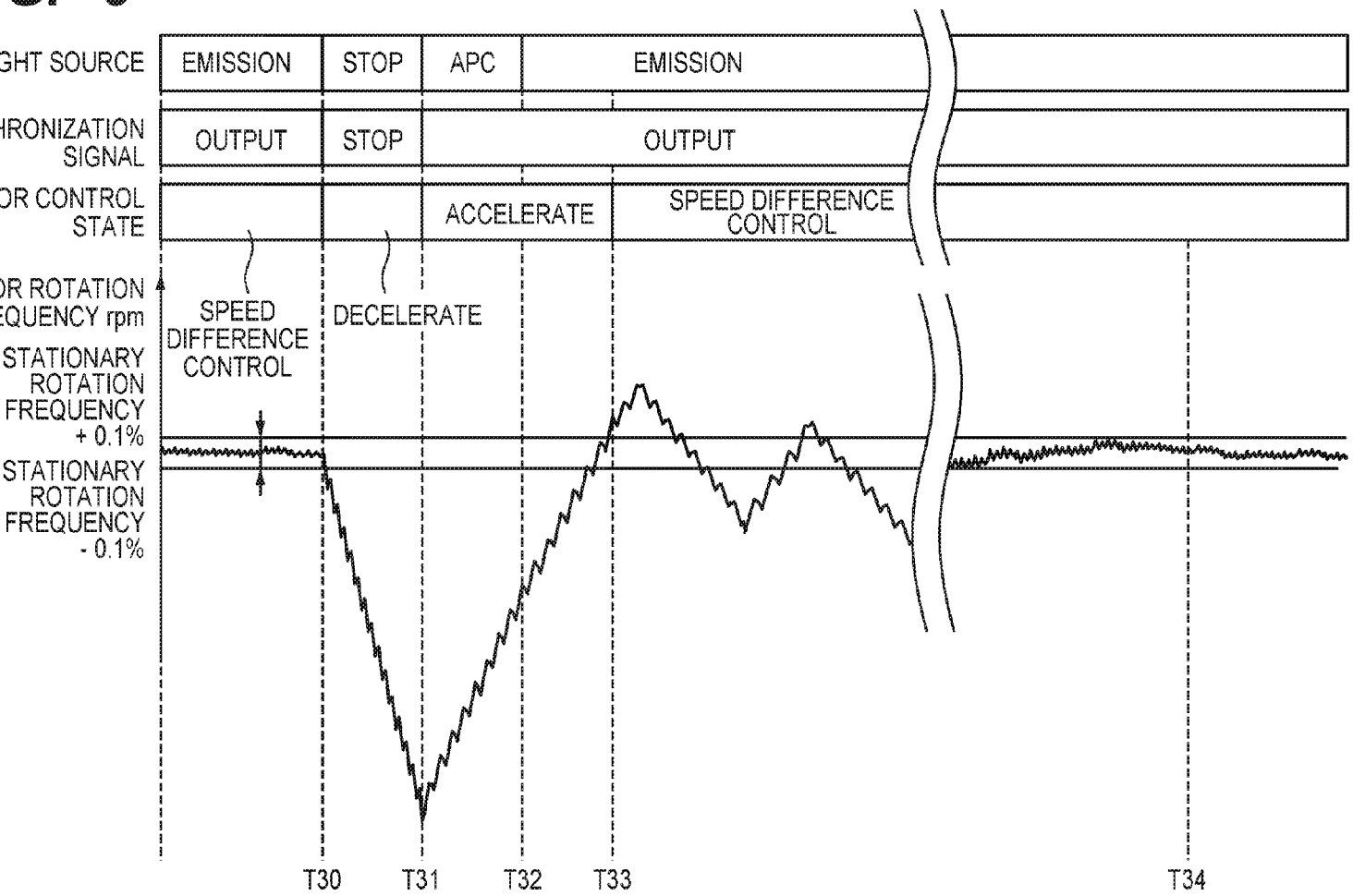
FIG. 9 is a timing chart of a case when a neutral state is not set in the light intensity modification processing.

FIG. 9 is a timing chart of a case when emission of the light source unit 207 is stopped and the deceleration control is performed in order to avoid the rotation speed of the motor 230 increasing as in FIG. 8. As in FIG. 9, it is possible to reduce an increase in the rotation frequency of the motor 230 by stopping the emission of the light source unit 207 and performing the deceleration control. However, the period from the time T30 to the time T34 becomes as long as a few hundred milliseconds, similarly to that in FIG. 8.

Next, description is given regarding a reason for causing an emission of a light source to stop at a time of a light intensity switch of a light source. Normally, when the DAC switches the inputted digital value, a period in which data is indefinite, in other words a glitch, occurs. A time required for the DAC to switch is a few nano seconds to a few microseconds, and there is a possibility that light will emit at an excessive intensity due to a glitch when a digital value inputted to the DAC is switched while the light source is not stopped and that a rated value of the light source unit 207 will be exceeded, damaging the light source unit 207. Although usage of a Gray code or a thermometer code to avoid a glitch can be considered, the circuit scale of the DAC increases and the cost increases. Accordingly, an emission of a light source is stopped at a time of switching the light intensity of a light source in the present embodiment. However, a configuration may be taken so that a Gray code or a thermometer code is used so that the light source is not stopped. In such a case, by setting control of the rotating polygon mirror to the neutral control, it is possible to reduce a fluctuation of the rotation speed of the rotating polygon mirror due to an incorrect detection of the synchronization signal based on the light intensity switch.

As described above, it is possible to stably and in a short time perform a change of emission intensity of a light source while maintaining the rotation speed of the rotating polygon mirror 133 in the present embodiment. Also, it is possible to reduce an increase in signal lines by comparison with an intensity setting according to a PWM signal. Also, it is possible to reduce circuit complexity and cost increase in a configuration that does not use a Gray code or a thermometer code for a DAC.

Second Embodiment

Subsequently, description is given regarding the second embodiment focusing on a point of difference with the first embodiment. For the present embodiment, a setting of the light intensity of the light source unit 207 is performed based on a surface potential of the photosensitive member 121 measured by the potential sensor 123 in FIG. 1.

Figure 10:
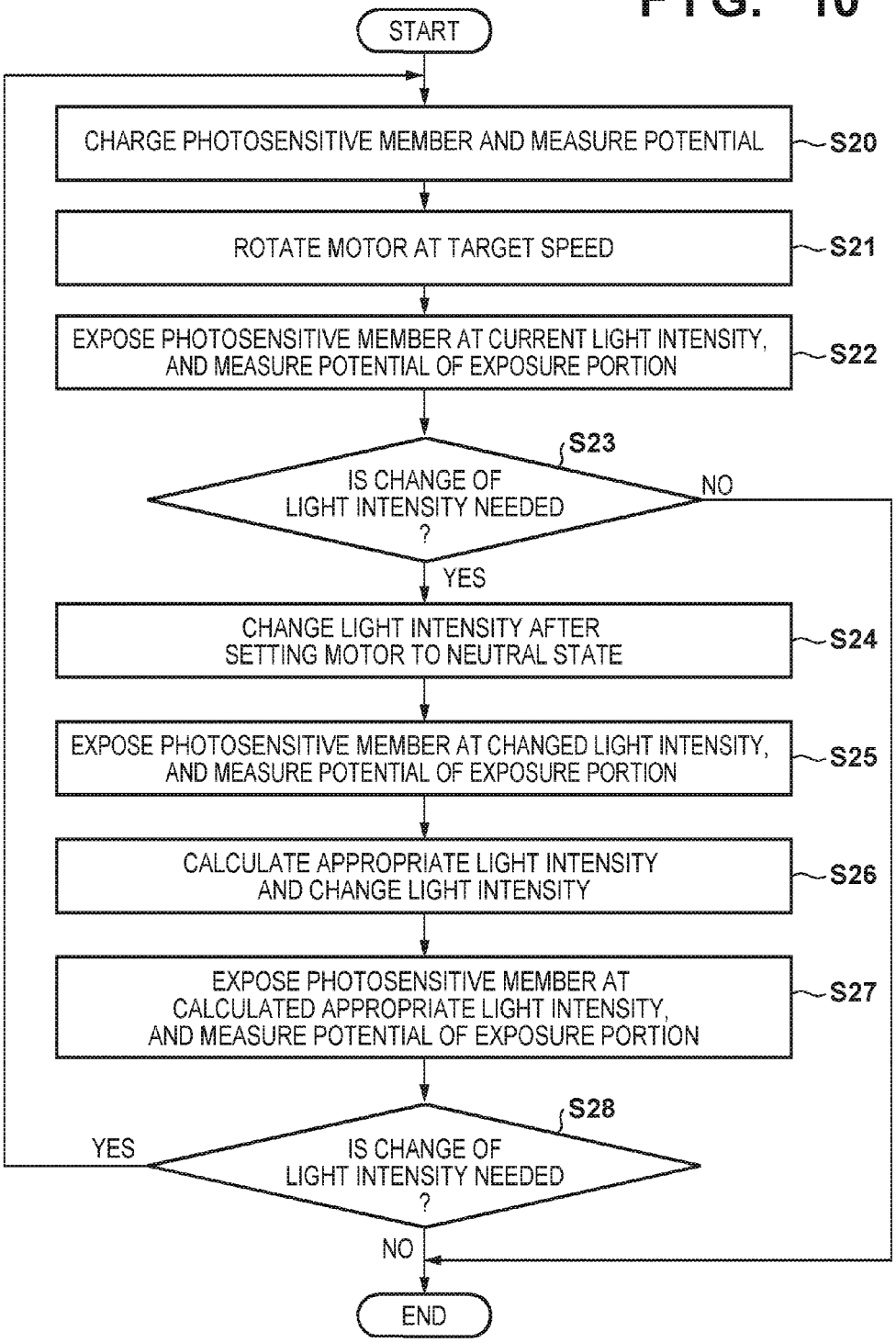
FIG. 10 is a flowchart of light intensity modification processing according to an embodiment.

FIG. 10 is a flowchart of an emission intensity control of the scanning unit 134 according to this embodiment. The processing of FIG. 10 is executed when a predetermined condition is satisfied. For example, the processing of FIG. 10 is executed when the environmental temperature or the humidity changes to greater than or equal to a predetermined value, when a part is replaced, or when a usage time of a part reaches a predetermined time. In step S20, the CPU 302 causes the photosensitive member 121 to be charged by the charge roller 122 and the potential sensor 123 measures the charging potential. Note, at that time, an emission of the light source unit 207 of the scanning unit 134 is stopped. In step S21, the ASIC 303 causes the light source unit 207 of the scanning unit 134 to emit and causes the motor 230 to rotate at a target speed. Note, the emission intensity at that time is a value that is set in the preceding emission intensity control. In step S22, the CPU 302 causes the photosensitive member 121 to be exposed by the scanning unit 134, and measures an electric potential of the exposed portion of the photosensitive member 121.

The CPU 302 determines in step S23 whether or not a change of light intensity of the scanning unit 134 is necessary based on a difference between the electric potential of the unexposed portion measured in step S20 and the electric potential of the exposed portion measured in step S22. Specifically, it is determined that the change of the light intensity of the scanning unit 134 is necessary when the difference between the electric potential of the unexposed portion and the electric potential of the exposed portion is not in a predetermined range. The CPU 302 ends the processing when a change of the light intensity of the scanning unit 134 is not necessary. Meanwhile, the ASIC 303 sets the motor 230 to the neutral state and the CPU 302 performs the change of the light intensity of the scanning unit 134 in step S24 when the change of the light intensity of the scanning unit 134 is necessary. Note, it is assumed that the post-change light intensity in step S24 is decided based on the difference between the electric potential of the unexposed portion and the electric potential of the exposed portion used in the determination of step S23 in the present embodiment. For example, configuration can be taken so that the light intensity is strengthened by a predetermined value in a case when it is necessary to strengthen the exposure intensity from the difference between the potential of the unexposed portion and the potential of the exposed portion used in the determination of step S23. Note, the light intensity increase amount may be determined from the difference value rather than strengthening the light intensity by a predetermined value. Note, it is similar in a case when the light intensity is weakened. Next, the CPU 302, in step S25, exposes the charged photosensitive member 121 at the changed light intensity and measures the electric potential of the exposed portion. Also, the CPU 302, in step S26, calculates an appropriate light intensity based on the electric potential of the exposed portion measured in step S25 and the electric potential of the unexposed portion measured in step S20, and changes the light intensity to the calculated appropriate light intensity. After that, the CPU 302, in step S27, exposes the charged photosensitive member 121 at the appropriate light intensity and measures the electric potential of the exposed portion. The CPU 302 again determines whether or not a change of light intensity is necessary based on the difference of the electric potential of the unexposed portion measured in step S20 and the electric potential of the exposed portion measured in step S27. The CPU 302 ends the processing if a change of the light intensity is not necessary, and repeats the processing from step S20 if it is necessary.

Note, in the flowchart of FIG. 10, when the change of the light intensity is necessary in step S23, the CPU 302 causes the light intensity in step S24 to increase or decrease and measures the surface potential by exposing the photosensitive member 121 at the changed light intensity in step S25, and by this, calculates the appropriate light intensity in step S26. However, a configuration in which, when the change of the light intensity is necessary in step S23, the electric potential of the exposed portion is measured by exposing the photosensitive member 121 at each of a light intensity stronger and a light intensity weaker than the light intensity prior to the change is also possible. In such a case, in step S26, an appropriate light intensity is calculated based on the electric potential of the exposed portion at a light intensity stronger than the light intensity prior to the change and the electric potential of the exposed portion at a light intensity weaker than the light intensity prior to the change. Also, in the flowchart of FIG. 10, when a change of the light intensity is necessary in step S23, the appropriate light intensity is calculated by changing the light intensity and measuring the electric potential of the exposed portion, and it is determined whether the appropriate light intensity is suitable by again measuring the electric potential of the exposed portion according to the appropriate light intensity. However, configuration may be taken so that it is determined in step S28 whether or not the changed light intensity is appropriate based on the electric potential of the exposed portion in step S25 and the electric potential of the unexposed portion measured in step S20, omitting step S26 and step S27.

Other Embodiments

Note, each of the foregoing embodiments were described using an image forming apparatus. However, it is possible to apply the present invention to an optical scanning apparatus that includes the scanning unit 134, the CPU 302, and the ASIC 303 in the above described embodiments for example.

Embodiments of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiments and/or that includes one or more circuits (e.g., application specific integrated circuit (ASIC)) for performing the functions of one or more of the above-described embodiments, and by a method performed by the computer of the system or apparatus by, for example, reading out and executing the computer executable instructions from the storage medium to perform the functions of one or more of the above-described embodiments and/or controlling the one or more circuits to perform the functions of one or more of the above-described embodiments. The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-100844, filed on May 19, 2016, which is hereby incorporated by reference herein in its entirety.

What is claimed is:

1. An image forming apparatus, comprising:

a light source;

a light driving unit configured to convert a digital value indicating an emission intensity of the light source to an analog signal and to drive the light source by a drive signal obtained based on the analogue signal;

a polygon mirror configured to be rotationally driven and to reflect light that the light source emits in order to expose a photosensitive member;

a detection unit configured to detect light that the light source emits and that is reflected by the polygon mirror in a predetermined direction, and to output a synchronization signal indicating a detection timing;

a speed control unit configured to perform acceleration/deceleration control of the polygon mirror in order to maintain a rotation speed of the polygon mirror based on the synchronization signal at a target speed; and a light intensity control unit configured to decide an emission intensity of the light source and notify the digital value to the light driving unit, wherein the speed control unit changes control of the polygon mirror to a neutral control in which neither acceleration nor deceleration control is performed in a case the light intensity control unit changes the light intensity of the light source when the speed control unit is performing the acceleration/deceleration control.

2. The image forming apparatus according to claim 1, wherein the light intensity control unit is further configured to notify the digital value that indicates a changed light intensity of the light source to the light driving unit after the speed control unit changes the control of the polygon mirror to the neutral control.

3. The image forming apparatus according to claim 1, wherein the light driving unit is further configured to, after the speed control unit changes the control of the polygon mirror to the neutral control, obtain the drive signal based on the digital value indicating a changed light intensity of the light source notified from the light intensity control unit.

4. The image forming apparatus according to claim 2, wherein the light driving unit is further configured to convert the digital value that indicates the changed light intensity of the light source notified from the light intensity control unit to an analog signal and to obtain the drive signal based on the digital value indicating the changed light intensity of the light source by driving the light source by the analog signal to perform an automated light intensity control.

5. The image forming apparatus according to claim 4, wherein the speed control unit is further configured to change the control of the polygon mirror from the neutral control to the acceleration/deceleration control after the light driving unit drives the light source by the drive signal based on the digital value that indicates the changed light intensity of the light source by the automated light intensity control.

6. The image forming apparatus according to claim 1, wherein the light driving unit can be set to a first mode in which the light source is caused to emit based on the drive signal and to a second mode in which the emission intensity of the light source is smaller than a predetermined value, and the light intensity control unit is further configured to set the light driving unit to the second mode in a case changing the light intensity of the light source when the speed control unit is performing the acceleration/deceleration control.

7. The image forming apparatus according to claim 1, further comprising a rotation driving unit configured to be controlled by the speed control unit and to cause the polygon mirror to rotate at a rotation speed in accordance with a rotation driving value, wherein the rotation driving unit is further configured to update the rotation driving value based on a speed modification instruction from the speed control unit during the acceleration/deceleration control and to not update the rotation driving value during the neutral control.

8. The image forming apparatus according to claim 1, wherein the light intensity control unit is further configured to decide a light intensity of the light source based on an attribute of a recording medium on which image formation is performed.

9. The image forming apparatus according to claim 1, wherein the light intensity control unit is further configured to decide a light intensity of the light source based on a difference between an electric potential of an exposed portion and an electric potential of an unexposed portion when light that the light source emits exposes the photosensitive member.

10. The image forming apparatus according to claim 1, wherein the light driving unit is further configured to convert the digital value indicating the emission intensity of the light source to the analog signal by a digital-to-analog converter.

11. The image forming apparatus according to claim 1, wherein the light driving unit is equipped with a register configured to store the digital value indicating the emission intensity of the light source, and the register is further configured to store each of a digital value indicating a light intensity when light reflected by the polygon mirror irradiates an image forming area of the photosensitive member and a digital value indicating a light intensity when light reflected by the polygon mirror is not irradiated on the image forming area of the photosensitive member.

12. The image forming apparatus according to claim 1, comprising a plurality of the light source, wherein the light driving unit is equipped with registers that store digital values indicating emission intensities of the plurality of the light source.

13. A scanning apparatus, comprising:

a light source;

a light driving unit configured to convert a digital value indicating an emission intensity of the light source to an analog signal and to drive the light source by a drive signal obtained based on the analogue signal;

a polygon mirror configured to be rotationally driven and to reflect light that the light source emits in order to expose a photosensitive member;

a detection unit configured to detect light that the light source emits and that is reflected by the polygon mirror in a predetermined direction, and to output a synchronization signal indicating a detection timing;

a speed control unit configured to perform acceleration/deceleration control of the polygon mirror in order to maintain a rotation speed of the polygon mirror based on the synchronization signal at a target speed; and a light intensity control unit configured to decide an emission intensity of the light source and notify the digital value to the light driving unit, wherein the speed control unit is further configured to change control of the polygon mirror to a neutral control in which neither acceleration nor deceleration control is performed in a case the light intensity control unit changes the light intensity of the light source when the speed control unit is performing the acceleration/deceleration control.

* * * * *